United States Patent [19]

Magnani

[11] 4,255,900

[45] Mar. 17, 1981

[54] SAFETY DEVICE FOR OPENING OF REVOLVING DOORS

[75] Inventor: Carla Magnani, Carpi, Italy

[73] Assignee: Elettromeccanica Mausoli S.r.l., Carpi, Italy

[21] Appl. No.: 17,271

[22] Filed: Mar. 5, 1979

[30] Foreign Application Priority Data

Mar. 3, 1978 [IT] Italy ..... 40032 A/78

[51] Int. Cl.[3] ..... E05B 65/10

[52] U.S. Cl. ..... 49/141; 49/42; 49/31; 52/64

[58] Field of Search ..... 49/141, 42, 44, 45; 22/67, 64; 109/8

[56] References Cited

U.S. PATENT DOCUMENTS

| | | | |
|---|---|---|---|
| 596,029 | 12/1897 | Ife | 49/44 |
| 1,024,797 | 4/1912 | Malocsay | 49/42 |
| 3,045,615 | 7/1962 | Atchison | 49/42 |

*Primary Examiner*—Kenneth Downey

*Attorney, Agent, or Firm*—Browdy and Neimark

[57] ABSTRACT

A safety apparatus is associated with otherwise conventional revolving doors which are rotatable about a vertical axis. A pair of closure components are positioned adjacent to the respective sides of a revolving door and are displaceable in the horizontal direction. The closure components include profiled surfaces which delimit access space of the revolving door. In case of emergency situations, e.g. caused by a fire, the closure components are moved away from one another under the power of two respective jacks, leaving access space around the sides of the door wide enough for the passage of persons.

9 Claims, 2 Drawing Figures

SAFETY DEVICE FOR OPENING OF REVOLVING DOORS

BACKGROUND OF THE INVENTION

This invention relates to a safety device for revolving doors and, in particular, for the doors revolving about a vertical axis placed in the center of the opening.

A revolving door has as its main feature the controlling and the limiting of the flow of persons coming through it in both directions until stopping it completely when the rotation of the door about its vertical axis is prevented.

There are known numerous application forms of revolving doors which are provided with hydraulical, pneumatical or electrical apparatus to produce, on command, a rotation and/or a locking of the revolving doors.

Similar applications are frequently employed for compulsory entrances and exits on the premises open to the public such as banks, offices and the like, where for safety reasons, it is desirable that the traffic of persons in the entrance and in the exit be sufficiently orderly and controllable.

Therefore it is particularly important, in such applications, that the revolving doors be provided with safety devices being able to face suitably emergency situations when there arises a need to make possible, even in the case when the revolving doors remain for any reason, locked, the normal flow of persons and/or even any increase thereof.

Similar emergency situations can be determined by a simple blocking up of the revolving door in a fixed position, caused by a breakdown or by an interruption of the correct operation of its drive means, or by external causes such as, for example, situations that put in danger the physical safety of persons, that are present on the premises accessible via the doors, and require fast evacuation of the above-mentioned premises.

For the time being there are not known any efficacious devices that are likely to assure and to allow an increase, in case of necessity, in revolving doors, the flow of persons which come through them.

SUMMARY OF THE INVENTION

The object of the present invention is, accordingly, to provide an automatic device to assure, in any case, and to allow an increase, in case of necessity, the flow of persons via one or more passageways adjacent the revolving door.

An advantage is provided by the present invention of a safety opening device of a simple construction provided with a great service reliability.

These and still other advantages are achieved by the present invention which can be characterized by the fact that it comprises: at least one vertical closure component furnished with a possibility to perform displacements in the horizontal direction, provided with a vertical profiled surface to delimit an access space of the revolving door; drive means to displace horizontally, on suitable command, the closure component from a position in which the profiled surface is adjacent to the revolving door to the position in which between the profiled surface and the revolving door exists a gap for for free transit so as to assure the desired possible flow of persons.

BRIEF DESCRIPTION OF THE DRAWINGS

Further features and advantages of the present invention are to become readily apparent from the detailed description that follows of a preferred, but not exclusive embodiment, illustrated for the sake of example, and not intended as a limitation of any kind, in the following figures where.

DETAILED DESCRIPTION OF THE PREFERRED EMBODIMENT

Figure 1:
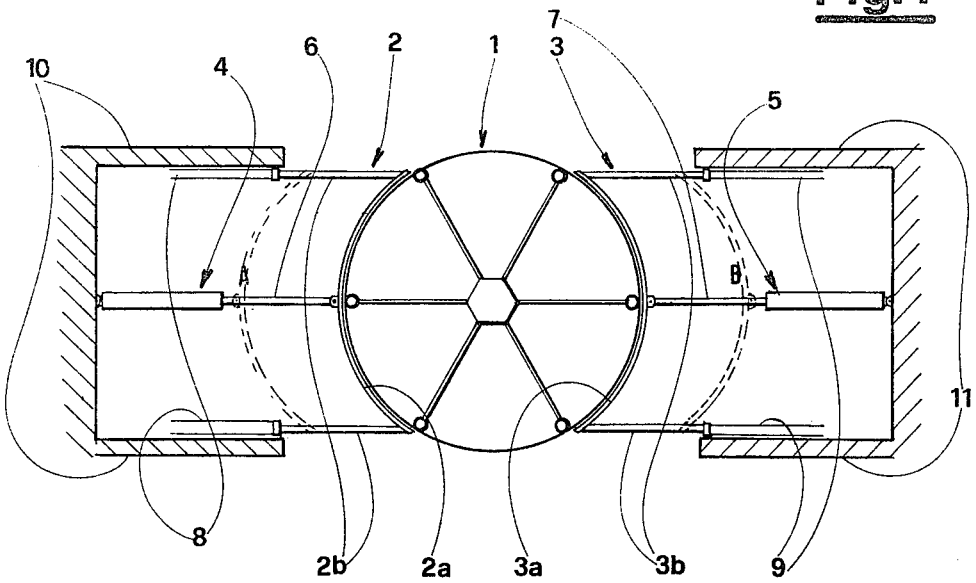
FIG. 1 shows a schematical horizontal view of the two safety devices applied symmetrically to a revolving door according to the present invention.
Figure 2:
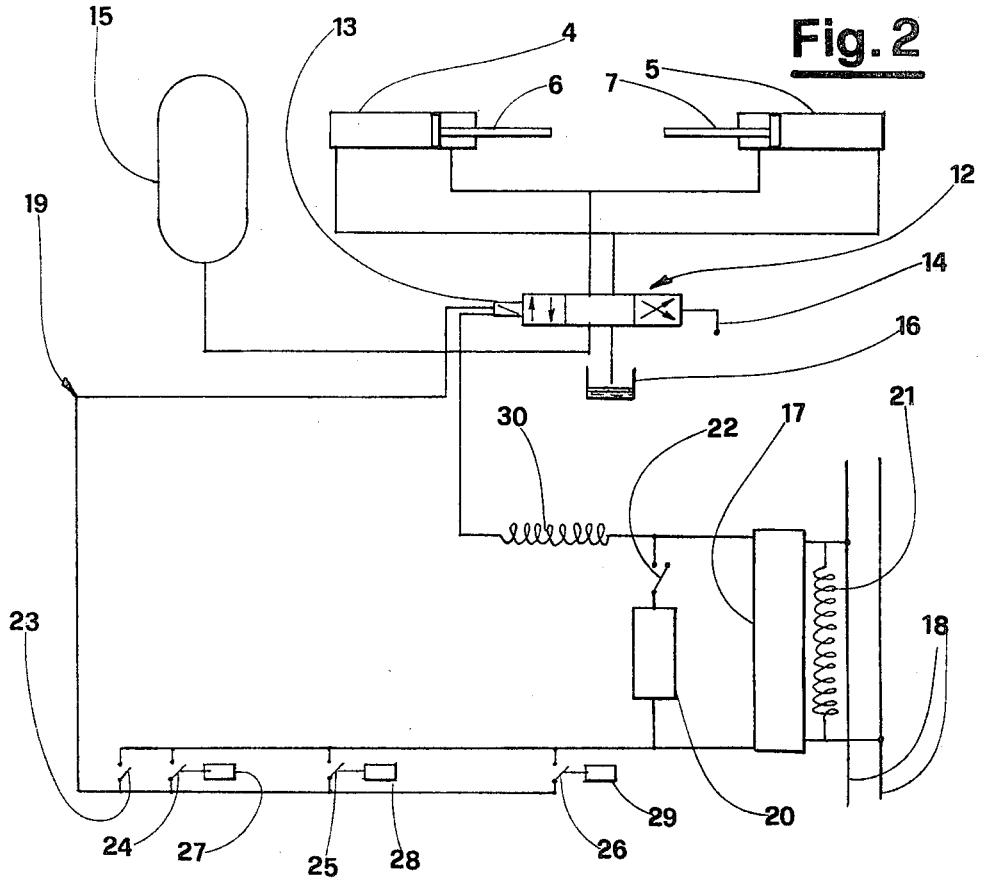
FIG. 2 shows the control circuit scheme and the hydraulical drive circuit scheme of the two devices shown in FIG. 1.

Referring now to FIGS. 1 and 2, (1) indicates generally a revolving door revolving about its vertical axis placed in the center of an opening, subdivided into six equal sections. The numerals (2) and (3) indicate two identical vertical closure components positioned to the left and right of the door (1). The closure components are displaceable in the horizontal direction and are, formed by two vertical profiled surfaces of a cylindrical form (2*a*) and (3*a*) which delimit an access space to the revolving door (1). The vertical profiled surfaces (2*a*) and (3*a*) are positioned respectively between two pairs of vertical lateral walls (2*b*) and (3*b*), sliding on a pair of horizontal guides (8) and (9) placed is parallel to one another and on the interior of pairs of fixed walls (10) and (11). The numerals (4) and (5) indicate two fixed hydraulic operating cylinders with piston rods (6) and (7) which are fixed respectively to the vertical closure components (2) and (3).

Said hydraulic operating cylinders are apt to provide the vertical closure components (2) and (3) with translatory motions along the horizontal direction parallel to the pairs of guides (8) and (9) and displace them, on suitable command, from the position when the profiled surfaces (2*a*) and (3*a*) are adjacent to the revolving door (1) to the positions A and B, indicated with broken lines in FIG. 1, in which between each of the profiled surfaces and the revolving door exists a gap which allows free transit so as to permit a continuous flow of persons. The hydraulic circuit and the operatively associated electrical control circuit of the operating cylinders (4) and (5) is shown in FIG. 2 in which (12) indicates a distribution valve for feeding of the cylinders provided with a control solenoid (13), and with control (14), for the electromagnetical and hand operation.

The number (15) indicates a pneumatic accumulator, fed by a suitable pumping circuit, not shown in a figure, connected to one of the ways of the valve (12).

The numeral (16) indicates a tank for the recovery of the hydraulic circuit fluid. A solenoid (13) is excited by an electrical circuit (19) fed, via a transformer-rectifier (17), by electrical mains (18). An electrical battery (20) can feed the circuit (19) in case of the interruption in the delivery of the electric energy from the mains. A minimum voltage relay (21) activates a switch (22) which connects to the circuit (19) the battery (20) when energy from the mains (18) fails.

There are provided switches (24), (25), (26) such that any of them is able to close (or to open) the circuit (19).

The switches (24), (25) and (26) are controlled by suitable sensors (27), (28) and (29) which sense a temperature increase, and the presence in the environment of smoke and gases, and to cause, acting independently each from the others on the corresponding switches (24), (25) and (26), the closure of the circuit (19).

A switch (23), controlled by a self-exciting solenoid (30), assures the preservation of the closure of the circuit (19) produced previously by any one of the sensors.

The deactivation of the circuit (19) occurs as a result of manual manipulation of the switch (23).

The operation of the safety device described above occurs in a manner indicated hereinafter.

The closure of any of the switches (24), (25) and (26) puts into action the solenoid (13) which operates controlling the distribution valve (12). The distribution valve (12) controls, in turn, the actuation of the operating hydraulic cylinders (4) and (5) in such a way that the piston rods (6) and (7) of the latter displace horizontally the vertical closure components (2) and (3), hence the profiled surfaces (2*a*) and (3*a*), from the initial positions adjacent to the revolving door (1), to the positions A and B in which between the profiled surface and the revolving door (1) exists a transit gap so as to permit the free flow of persons. The pneumatic accumulator (15) provides for a pressurized fluid necessary for feeding the operating hydraulic cylinders (4) and (5). The actuation of the operating hydraulic cylinders (4) and (5) is assured, even in the case of the interruption in the delivery of the electrical energy from the mains (18), by the hand control (14) as well as by the battery (20).

The automatic connection of the battery (20) to the circuit (19) is provided for by the minimum voltage relay (21) which acts directly on the switch (22) causing the closure whenever an interruption in the delivery of the electrical energy from the mains (18) occurs.

The circuit (19) is then de-energized by opening by hand the switch (23). Operating manually the control (14) there are actuated the operating fluidodynamical cylinders (4) and (5) in such a way so as to bring the closure components (2) and (3), sliding on their respective guides (8) and (9), back to the initial positions adjacent to the revolving door (1).

Obviously, there may be applied to the present invention numerous modifications of practical and applicative nature of the constructive details, without departing from the scope of protection of the invention as claimed hereinafter.

I claim:

1. A safety device for a revolving door positioned in an access space for rotation about a given vertical axis, the device comprising at least one horizontally moveable vertical closure component positioned adjacent said revolving door, said closure component having a vertical profiled surface which defines a horizontal extent of said access space; drive means coupled to said vertical closure component for selectively displacing said closure component linearly in a horizontal direction from a position in which said profiled surface is immediately adjacent said revolving door to a position in which a gap defining a passageway is provided between said profiled surface and said revolving door; and command control means coupled to said drive means for energizing same selectively.

2. A safety device according to claim 1, including an additional horizontally moveable vertical closure component positioned adjacent said revolving door opposite said at least one closure component, said additional closure component having an additional vertical profiled surface which defines an additional horizontal extent of said access space; additional drive means coupled to said additional vertical closure component for selectively displacing said additional closure component linearly in a horizontal direction from a position in which said additional vertical profiled surface is immediately adjacent said revolving door to a position in which a gap defining an additional passageway is provided between said additional profiled surface and said revolving door to allow additional free flow of persons past said revolving door.

3. A safety device according to claim 2, wherein said command control means is coupled to said additional drive means for energizing same selectively.

4. A safety device according to claim 2, wherein said drive means and said additional drive means comprises respective hydraulic operating cylinders supplied with fluid under control of a pneumatic accumulator.

5. A safety device according to claim 1, wherein said drive means comprises at least one hydraulic operating cylinder supplied with fluid under control of a pneumatic accumulator.

6. A safety device according to claim 1 or claim 2, wherein said command control means comprises at least one sensor responsive to an environmental condition.

7. A safety device according to claim 6, wherein said at least one sensor comprises at least one temperature sensor.

8. A safety device according to claim 6, wherein said at least one sensor comprises at least one smoke sensor.

9. A safety device according to claim 6, wherein said at least one sensor comprises at least one gas sensor.

* * * * *